United States Patent [19]

Goodwin et al.

[11] Patent Number: 4,667,949

[45] Date of Patent: May 26, 1987

[54] SHEET STACKING DEVICE

[75] Inventors: Eber L. Goodwin, Arlington Heights; James E. Zeigler, Cary, both of Ill.

[73] Assignee: AM International, Inc., Chicago, Ill.

[21] Appl. No.: 498,340

[22] Filed: May 26, 1983

[51] Int. Cl.[4] ..... B65H 51/00

[52] U.S. Cl. ..... 271/207; 271/117; 271/177; 271/209; 271/309

[58] Field of Search ..... 271/113, 117, 207, 209, 271/309, 225, 171, 303, 185, 177, 180, 195, 211, 220, 223, 224, 188, 178, 179

[56] References Cited

U.S. PATENT DOCUMENTS

| | | | |
|---|---|---|---|
| 2,937,021 | 5/1960 | Keil | 271/188 |
| 3,160,413 | 12/1964 | Faeber | 271/188 |
| 4,260,148 | 4/1981 | Diesch et al. | 271/224 |
| 4,313,669 | 2/1982 | Larson et al. | 271/209 |
| 4,372,550 | 2/1983 | Woods | 271/211 |
| 4,441,702 | 4/1984 | Nagel et al. | 271/180 |

*Primary Examiner*—John J. Love
*Assistant Examiner*—John A. Carroll
*Attorney, Agent, or Firm*—Nicholas A. Camasto; John R. Hoffman

[57] ABSTRACT

In a printing machine or the like wherein sheets are delivered seriatim into a receiving tray whereat the sheets come to rest by gravity onto a stack in the tray, a device for facilitating stacking the sheets into the tray at high speed. Each sheet is directed from the machine in a path outwardly over the tray. Guide surfaces act against a lead end of the sheet to prevent upward escape of the sheets from the path. A deflecting mechanism diverts each sheet downwardly into the tray to clear the path for a succeeding sheet. A stop plate is provided beneath the deflecting mechanism for acting against a trail end of each sheet to control and guide the sheet into alignment onto the stack in the tray.

4 Claims, 10 Drawing Figures

FIG. 6
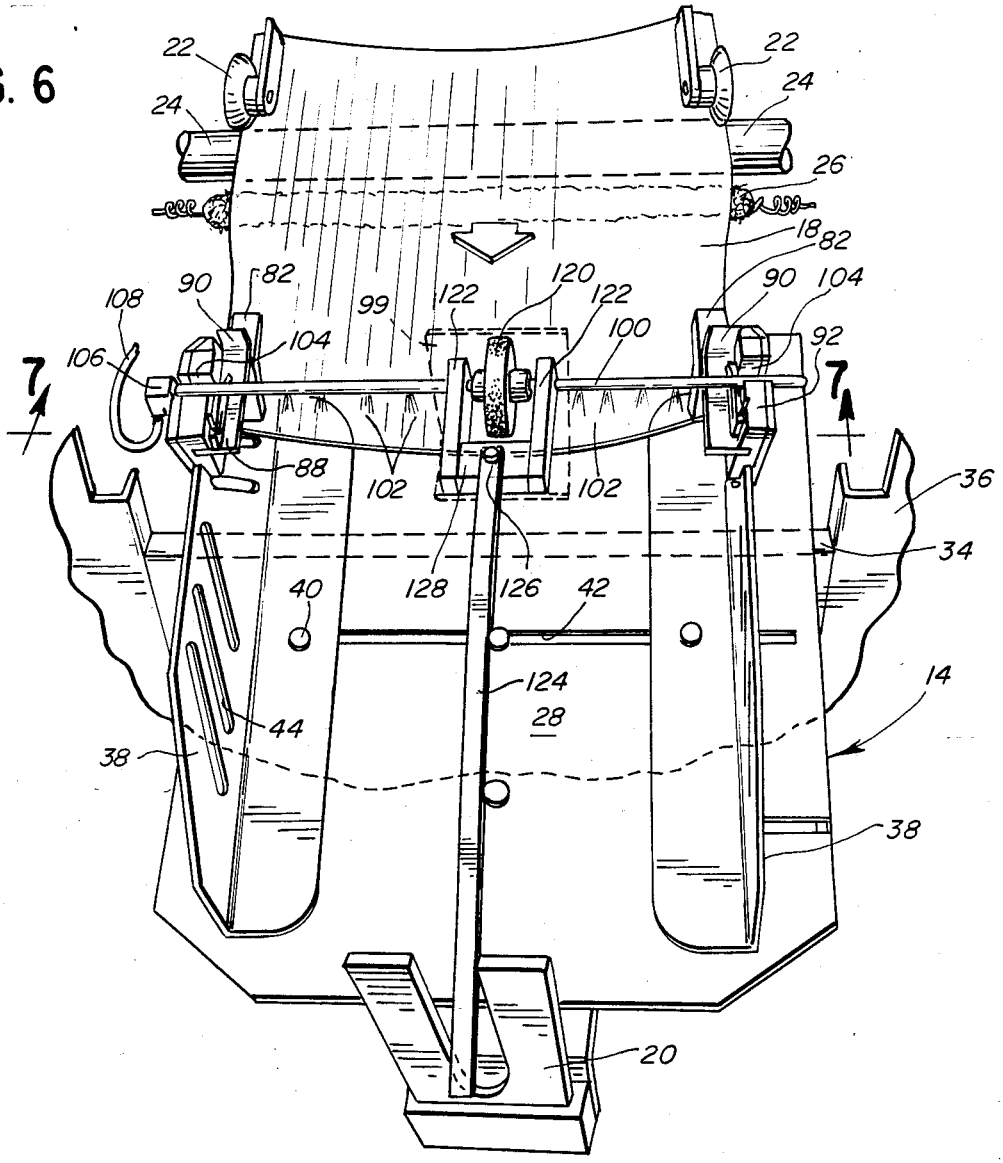
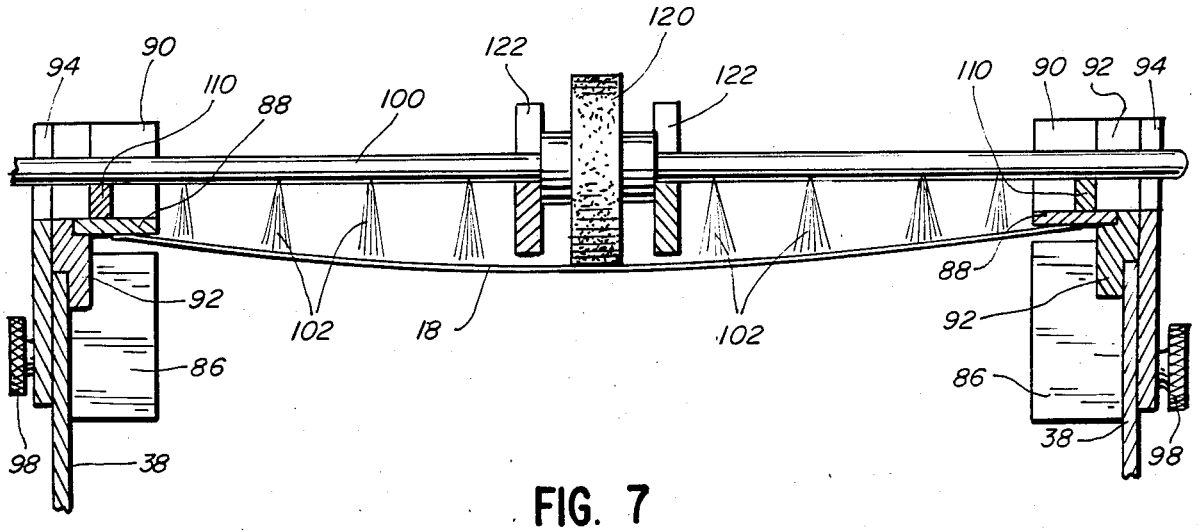
FIG. 7

FIG. 8
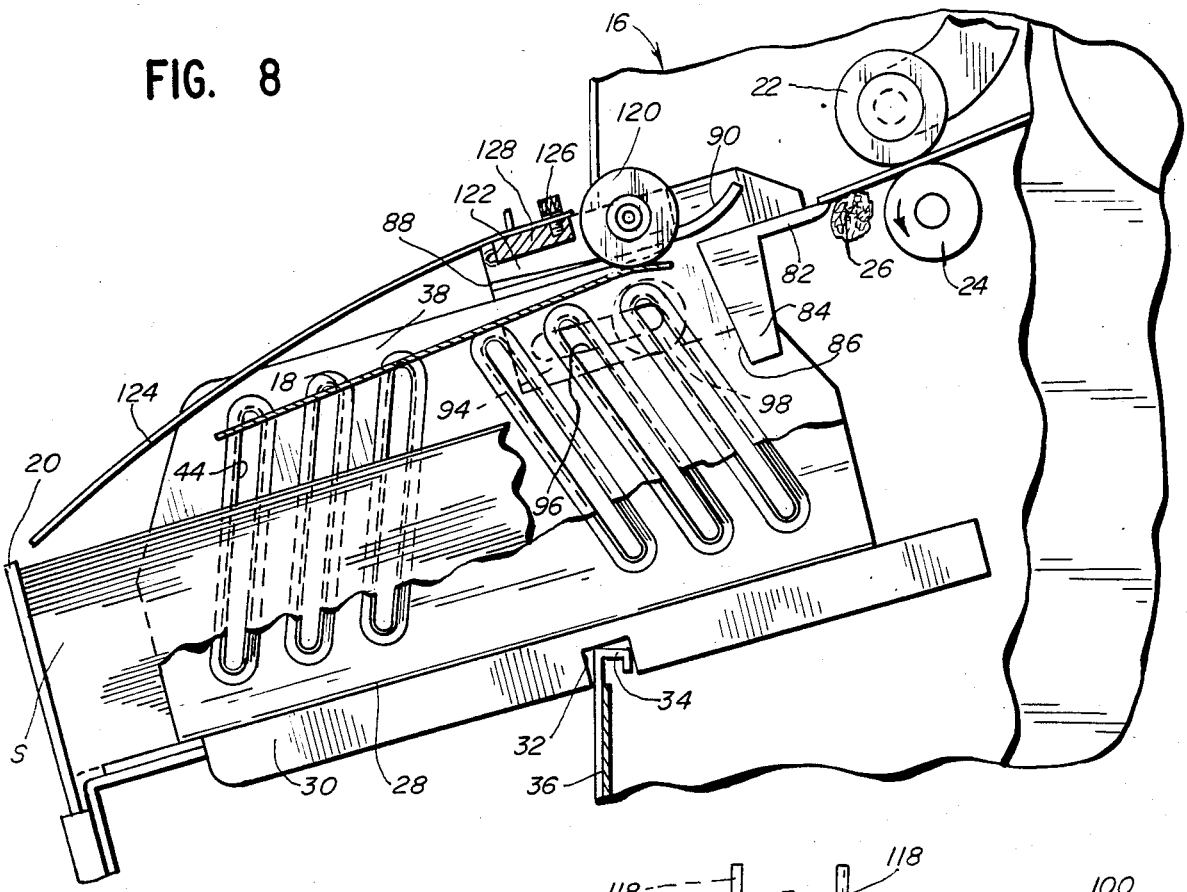
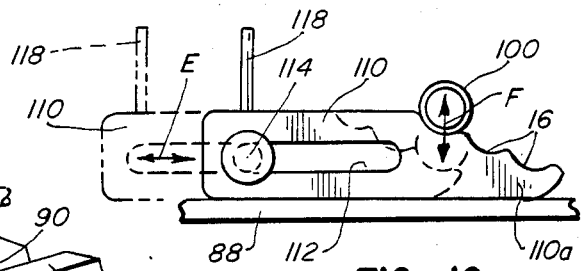
FIG. 10
FIG. 9
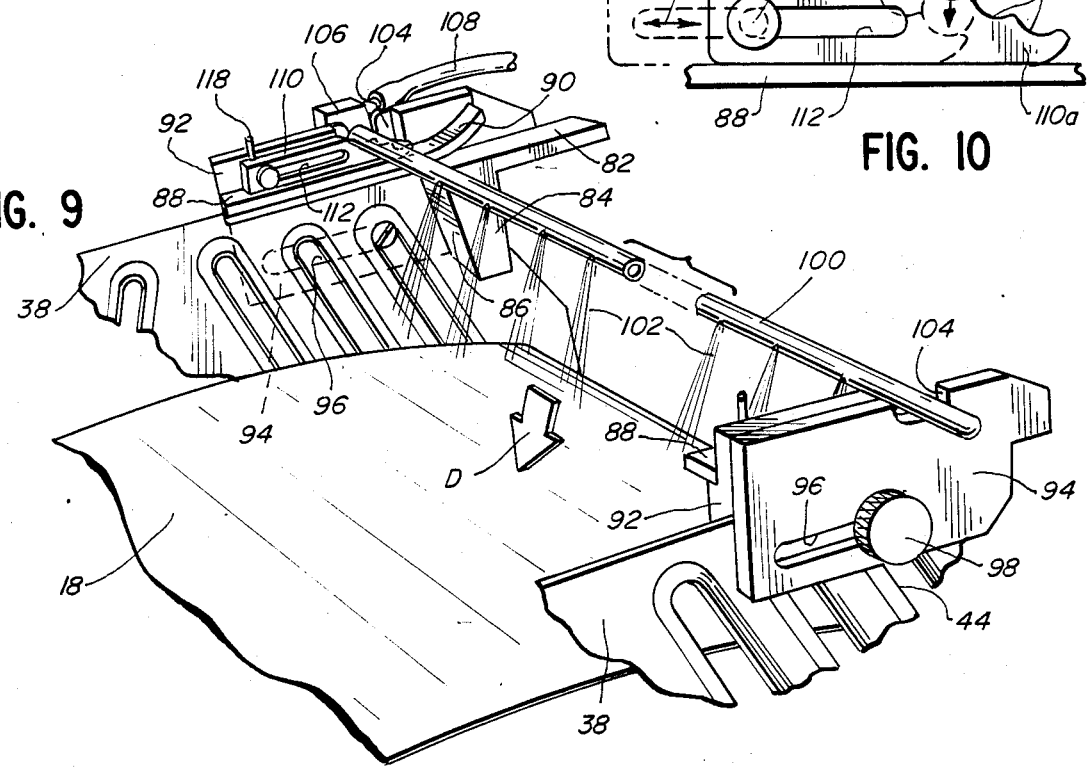

SHEET STACKING DEVICE

BACKGROUND OF THE INVENTION

This invention relates to sheet stacking devices and, particularly, to a device for stacking sheets delivered seriatim to the device at the exit end of a printing machine or the like.

Printing, copying or duplicating machines, such as rotary offset lithographic duplicating machines, normally are provided with some form of sheet receiving means at the exit end of the machine for stacking copy sheets issuing from the machine. Conventionally, the sheet receiving means comprises a receiving tray for receiving and stacking the sheets as the sheets fall by gravity and come to rest onto the top of a stack in the tray. Periodically, or when the tray is full, the stack of sheets is removed from the tray by the machine operator. Prior devices of this general kind have been fairly successful in instances where the duplicating machine speed is maintained at approximately 8,000 or less impressions per hour (IPH). However, such prior devices cannot handle stacking sheets at higher machine speeds such as on the order of 9,000 to 20,000 IPH. At the higher speeds, the sheets cannot be controlled and therefore jamming results.

There are various causes of sheet jamming at high machine speeds. First, prior machines normally do not have adequate means for directing the sheets outwardly over the tray. The lead ends of the sheets issuing from the machine drop too quickly before the sheets are directed a sufficient distance outwardly over the tray and therefore the sheets tend to roll or curl as the sheets fall into the tray. Attempts have been made to solve this problem by including flexible straps or deflectors acting against a substantial portion of each sheet to urge the sheets downwardly into the tray in an attempt to control the sheets being deposited in the tray. However, such flexible straps create considerable static electricity at high speeds and cause the sheets to adhere to the straps thereby resulting in sheet jamming.

Another problem with handling sheets at high machine speeds is in controlling upward deflection of the lead ends of the sheets. As the sheets issue from the machine, there often is a tendency for the lead ends of the sheets to "hang" or flip upwardly due to air resistance and further causes jamming.

Probably the most prevalent cause of sheet jamming at high machine speeds simply resides in the inability of a sheet to fall sufficiently fast to clear a path for the immediately succeeding sheet. Heretofore there has been no adequate means for controlling the trail ends of the sheets to avoid sheet jamming at high speeds. Because there is only a small gap between the trail end of a given sheet and the lead end of a succeeding sheet issuing from the machine, means must be provided for controlling the trail ends of the sheets to cause the trail end of a given sheet to drop immediately and clear a path for the lead end of an oncoming sheet in order to handle sheets issuing from the machine at high speed.

The invention is directed to a device for facilitating stacking the sheets into the tray at high machine speeds and avoiding the aforementioned problems of sheet jamming.

SUMMARY OF THE INVENTION

An object, therefore, of the invention is to provide a new and improved device for facilitating stacking sheets at high speed into a sheet receiving tray.

Another object of the invention is to provide a sheet stacking device of the character described which is particularly applicable in duplicating, copying or printing machines such as rotary offset lithographic duplicating machines.

A further object of the invention is to provide a sheet stacking device of the character described which controls both the lead ends and the trail ends of sheets issuing at high speed from a printing machine or the like.

In the exemplary embodiment of the invention, the sheet stacking device is shown in conjunction with a printing machine wherein sheets are delivered seriatim into a receiving tray whereat the sheets come to rest by gravity onto a stack in the tray. The stacking device includes support means for directing each sheet from the machine in a path outwardly over the tray. Guide means are provided for acting against a lead end of each sheet to prevent upward escape of the sheets from the path. Deflecting means are provided for diverting each sheet downwardly into the tray to clear the path for a succeeding sheet. Stop means are provided beneath the deflecting means for acting against a trail end of each sheet to control and guide the sheets into alignment onto the stack in the tray.

In one form of the invention, the guide means and the deflecting means comprise guide surface means extending laterally into the path at each side of the tray, above the stack, for engaging the sheets at their marginal side edges. Each guide surface means includes an upwardly flared end at an entry end for preventing upward escape of the sheets from the path, and a downwardly flared end at an exit end for diverting the sheets downwardly to clear the path for succeeding sheets.

In another form of the invention, the deflecting means comprises a perforated tube extending laterally across and above the path for directing a stream of air into the path for diverting each sheet downwardly out of the path to clear the path for an oncoming sheet.

The stop means beneath the deflecting means for acting against a trail end of each sheet to guide the sheets into alignment onto the stack in the tray comprises an abutment surface angled downwardly and forwardly relative to the sheet path. The tray itself has a back stop plate for arresting the sheets being deposited into the tray and aligning the lead ends of the sheets in the stack. With high speed delivery into the tray, the sheets tend to "kick back" away from the back stop plate, and the angled abutment surface of the invention acts against the trail ends of the sheets and deflects the sheets downwardly into alignment onto the stack in the tray.

A further feature of the invention is the provision of means for adjusting the position of the deflecting means longitudinally of the sheet path to accommodate sheets of varying weights or types.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 6 is a top-front perspective view similar to that of FIG. 4, illustrating a sheet stacking device incorporating another form of deflecting means in accordance with the invention;

FIG. 7 is a section taken generally along line 7—7 of FIG. 6;

FIG. 8 is a side elevation similar to that of FIG. 1, but illustrating the alternate form of sheet deflecting means;

FIG. 9 is a fragmented perspective view of the form of sheet stacking device shown in FIG. 6; and FIG. 10 is a fragmented side elevation of the means for adjusting the position of the sheet deflecting means of FIGS. 6–9.

DETAILED DESCRIPTION OF THE PREFERRED EMBODIMENT

Figure 1:
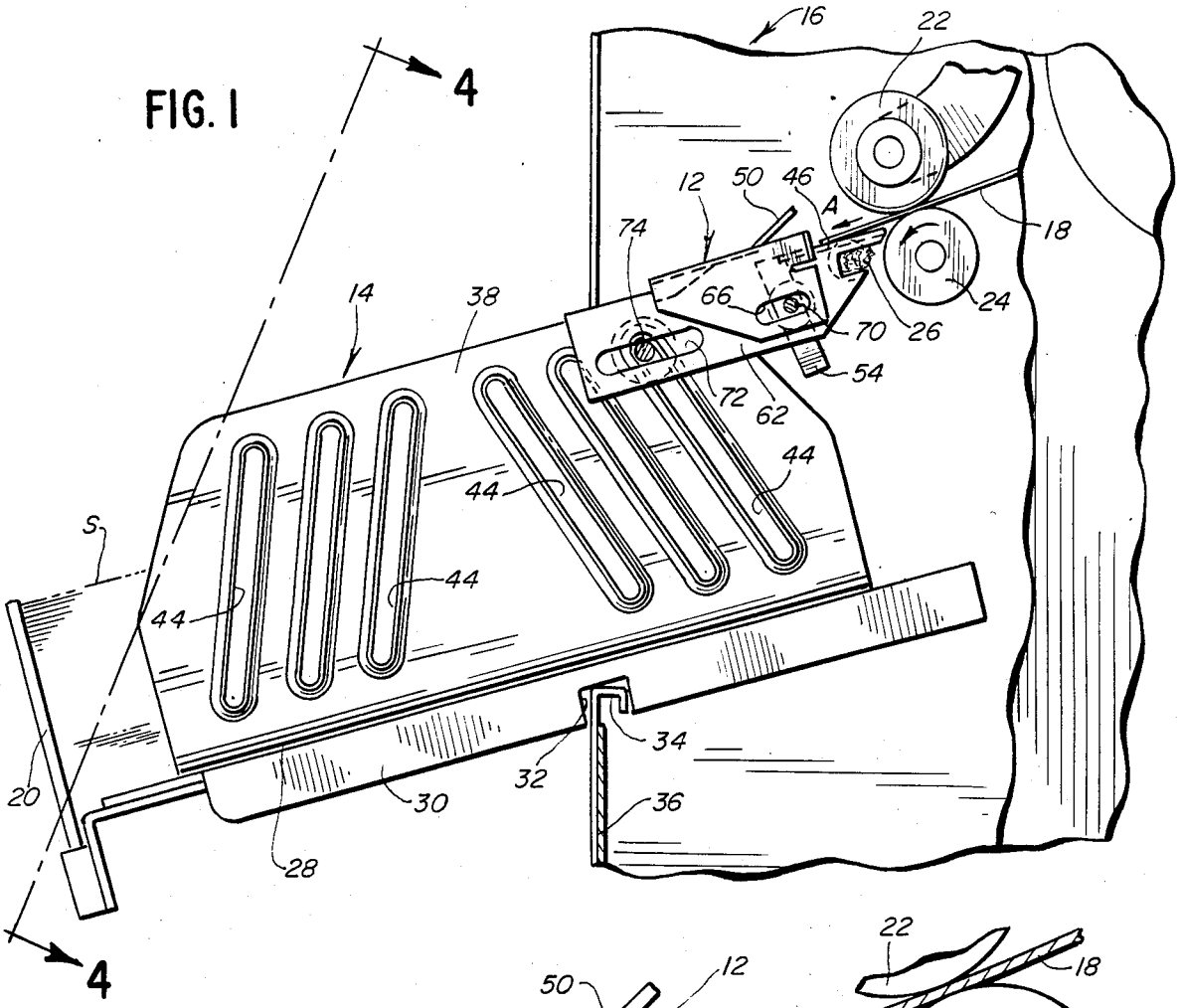
FIG. 1 is a side elevation of a sheet receiving tray incorporating one form of the sheet stacking device of the invention, disposed at the exit end of a printing machine shown fragmented.
Figure 4:
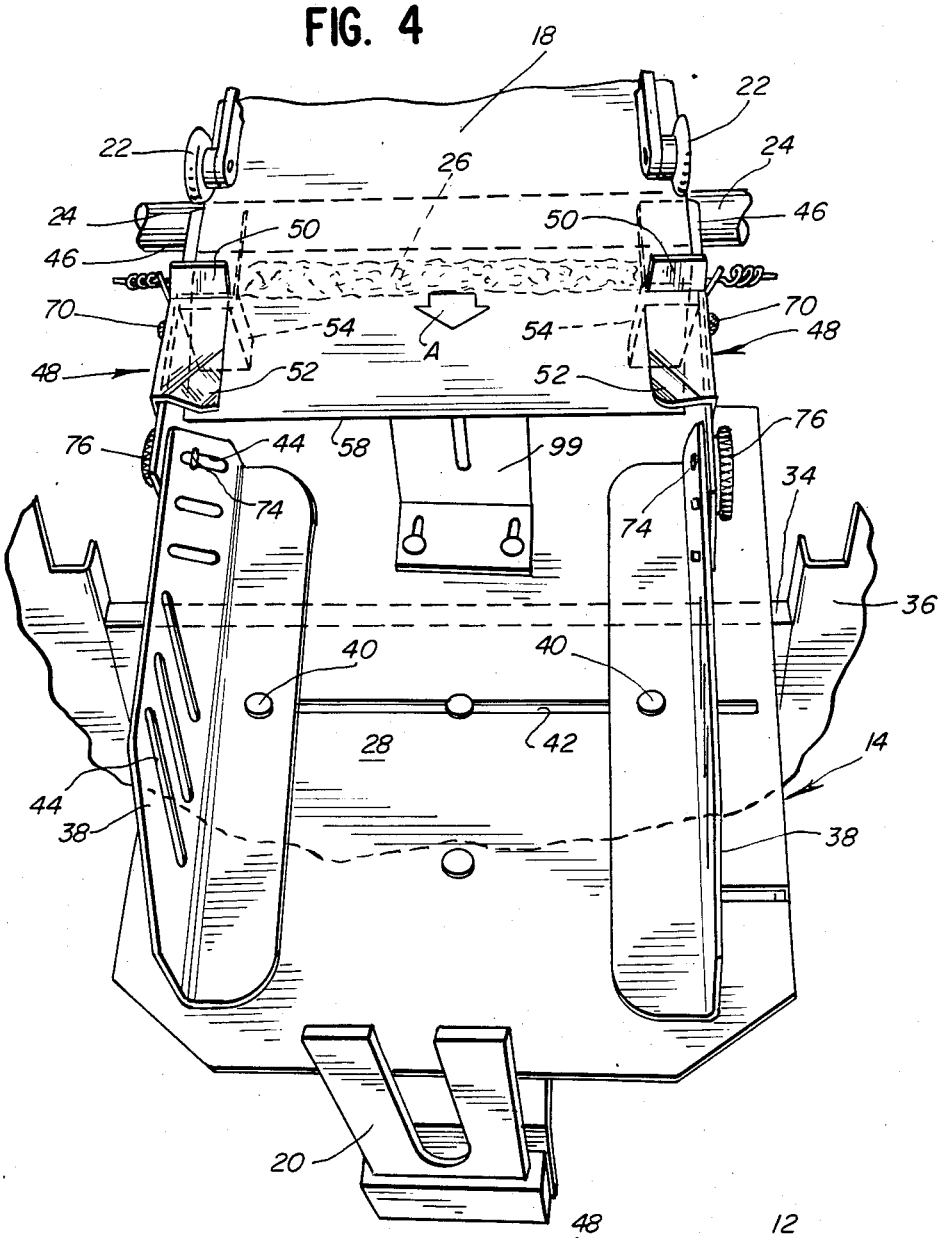
FIG. 4 is a top-front perspective view of the device as viewed in the direction of line 4—4 of FIG. 1.

Referring to the drawings in greater detail, and first to FIGS. 1 and 4, the sheet stacking device of the present invention is generally designated 12 and is mounted on a receiving tray, generally designated 14, at the exit end of a printing, copying or duplicating machine, generally designated 16. Copy sheets 18 issue from the printing machine in the direction of arrow A and are deposited onto a stack S in tray 14 with the lead ends of the sheets arrested and aligned against a vertical back stop 20.

Printing machine 16 includes a pair of ejector wheels 22 in rolling contact with a roller 24 for issuing or discharging sheets 18 from the printing machine toward tray 14. A strand of tinsel material 26 may be provided, extending transverse to the direction of the sheet path defined by arrow A, in contact with the underside of the copy sheets to reduce static electricity in the sheets.

Sheet receiving tray 14 includes a bottom platform 28 having a downwardly depending flange 30 at each marginal edge (only one flange 30 being shown in FIG. 1). Flanges 30 are provided with notches 32 for engaging a lip 34 of a cover 36 of the printing machine to permit mounting the tray at a slight angle downwardly and outwardly from the machine. Although not shown in the drawing, tray 14 is further stabilized on the machine and is adapted for minute lateral movement relative to the sheet path to permit positioning the tray in alignment with the sheets issuing from the machine.

Tray 14 also includes a pair of side guide walls 38 mounted on platform 28 for acting against the side edges of sheets 18 to align the sheets in a stack in the tray. Side walls 38 have spring fasteners 40 (FIG. 4) coacting with a transverse slot 42 in platform 28 to permit lateral adjustment of the side walls relative to the platform for accommodating sheets of various widths. Side walls 38 also are provided with cut-outs 44 to permit passage of air therethrough to facilitate the stacking of sheets 18 into the tray.

Thus, it can be seen that sheets 18 are delivered seriatim from printing machine 16 into receiving tray 14 whereat the sheets come to rest by gravity onto stack S in the tray. The invention is directed particularly to device 12 for facilitating stacking the sheets into the tray at high speeds without causing jamming. It is contemplated that the sheet stacking device is readily applicable for other types of duplicating, copying or printing machines or the like, as well as different forms of sheet receiving trays.

More particularly, and referring to the full complement of FIGS. 1–5, sheet stacking device 12 includes a pair of platform sections 46 disposed at opposite sides of the sheet path for engaging the sheets at their marginal side edges. The platform sections direct each sheet from the machine in path A outwardly over tray 14.

Guide means, generally designated 48, are disposed at opposite sides of the sheet path and generally include both guide means for acting against a lead end of each sheet to prevent upward escape of the sheets from the path as well as deflecting means for diverting each sheet downwardly into tray 14 to clear the path for a succeeding sheet. As with platform sections 46, guide means 48 extend laterally into the sheet path for engaging the sheets at their marginal side edges. More particularly, each guide means 48 includes a first, upwardly flared guide end 50 at an entry end for preventing upward escape of the sheets from the path, and a second, downwardly flared guide end 52 at an exit end for diverting the sheets downwardly into the tray to clear the path for a succeeding sheet.

A stop plate 54 is provided beneath guide means 48 at each side of the sheet path for acting against a trail end of each sheet to control and guide the sheets into alignment onto the stack of sheets in the tray. In particular, stop plate 54 has an abutment surface 56 angled downwardly and forwardly relative to the sheet path.

Figure 2:
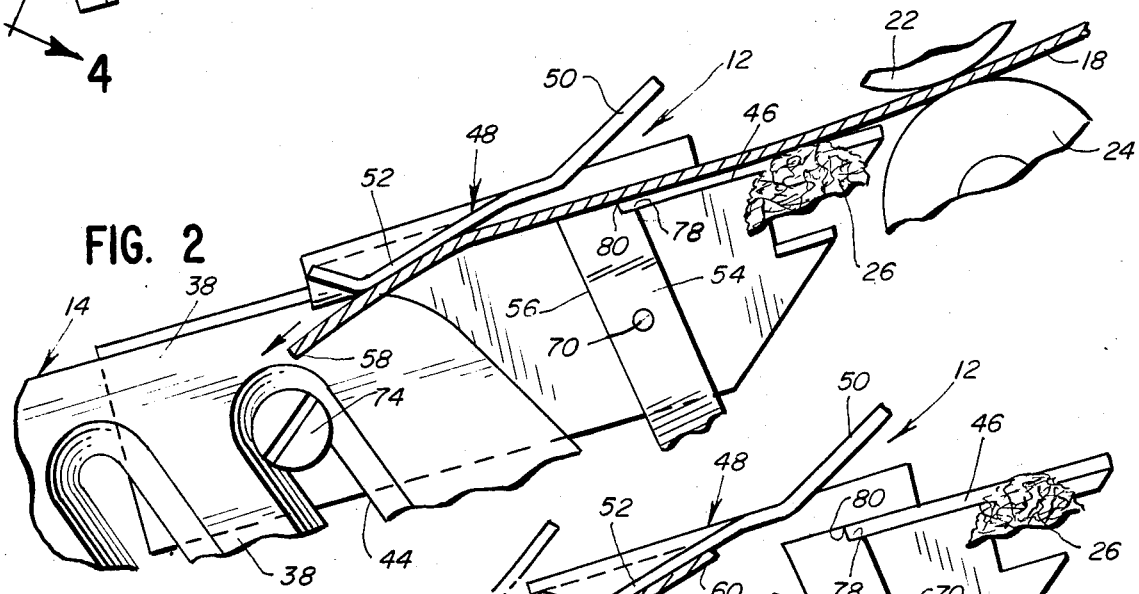
FIG. 2 is a fragmented side elevation of the sheet stacking device of FIG. 1, with a lead end of a sheet being diverted from a path into the tray.

The operation of sheet stacking device 12, including platform sections 46, guide means 50 and stop plate 54 will be described in relation to FIGS. 2 and 3. As a sheet 18 is delivered from machine 16, between ejector wheels 22 and roller 24, platform sections 46 direct the sheet from the machine in a path outwardly over tray 14. Upwardly flared end 50 acts against a lead end 58 of sheet 18 to prevent upward escape of the sheet from its path of travel. This is particularly important for sheets delivered at high machine speeds. Downwardly flared end 52 diverts lead end 58 of sheet 18 downwardly into the tray as illustrated in FIG. 2.

Figure 3:
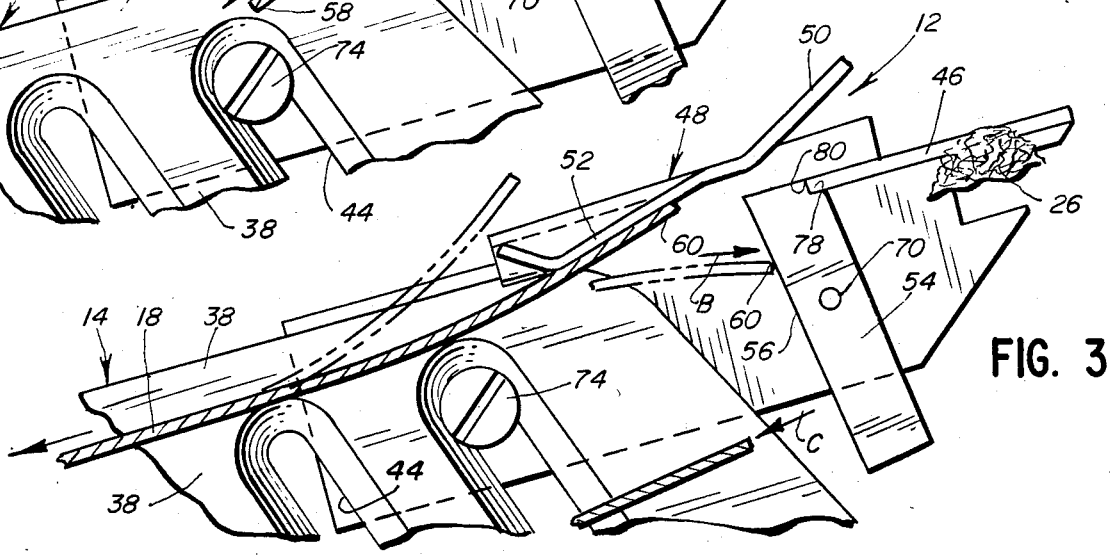
FIG. 3 is a fragmented side elevation of the sheet stacking device of FIG. 1, with a trail end of the sheet being diverted from the path into the tray.

As shown in FIG. 3, as sheet 18 continues into tray 14 and begins to fall by gravity, downwardly flared end 52 diverts a trail end 60 of the sheet downwardly into the tray to clear the path for a succeeding sheet. In some instances, without downward deflection, a sheet actually could flip upwardly as shown in phantom in FIG. 3.

As sheet 18 continues in its rapid path of travel, it will abut against back stop 20 of tray 14 and tend to "kick back" as shown in phantom and in the direction of arrow B in FIG. 3. Trail end 60 of the sheet then comes into engagement with the angled abutment surface 56 of stop plate 54. The sheet is directed downwardly in the direction of arrow C into the tray in a controlled and guided fashion whereby the sheet comes into alignment onto the top of the stack of sheets in the tray.

Figure 5:
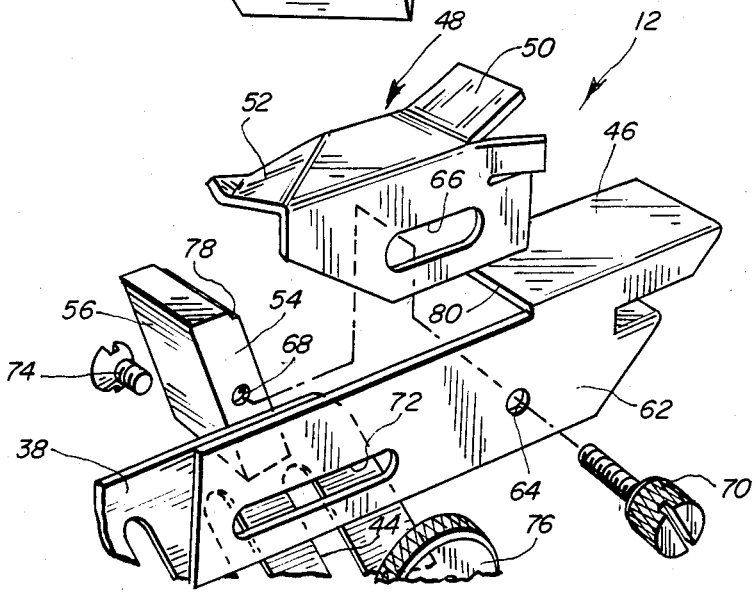
FIG. 5 is an exploded perspective view of the sheet stacking device of FIG. 1.

FIG. 5 shows the means for mounting sheet stacking device 12 to the side walls 38 of sheet receiving tray 14. Of course, the device includes support means, guide means, deflecting means and stop means at opposite sides of the sheet path on each tray side wall as described above. Only one is shown in FIG. 5 and will be described accordingly. More particularly, platform section 46 includes a downwardly depending flange 62 having a through hole 64. Guide means 48 has a slot 66 elongated in the direction of the sheet path. Stop plate 54 has a threaded bore 68 extending transversely of the path. A threaded fastener 70 extends through hole 64 and elongated slot 66 and is threaded into bore 68 to clamp platform section 46, guide means 48 and stop plate 54 together as a unit. Flange 62 of platform section 46 also has a slot 72 elongated in the direction of the sheet path. A screw 74 extends through one of the cutouts 44 in side wall 38 and through elongated slot 72 in flange 62, and a thumb wheel nut 76 is threaded onto the screw. Stop plate 54 has a notch 78 along its upper edge for engaging a front edge 80 of platform section 46 to position and stabilizc the stop plate.

With the assembly described immediately above, both platform section 46 and guide means 48 are adjustable longitudinally of the sheet path to accommodate sheets of varying weights or types. In order to adjust the entire assembly as a unit, thumb wheel nut 76 is loosened on screw 74 and platform section 46 can be moved to position the entire unit. However, guide means 48 can be adjusted independently of the unit by loosening threaded fastener 70. Due to the elongation of slot 66, guide means 48 can be adjusted and retightened to various positions longitudinally of the sheet path to accommodate sheets of varying weights and types.

FIGS. 6–10 show an alternative device for facilitating stacking sheets 18 into tray 14 and particularly includes an alternate form of means for diverting the sheet downwardly into the tray to clear the path for a succeeding sheet. It should be noted that like components, particularly those of the printing machine and the receiving tray, have been designated with like numerals as applied in FIGS. 1–5.

More particularly, the sheet stacking device of FIGS. 6–10 includes platform sections 82 for directing each sheet from the machine in a path outwardly over the tray as indicated by arrow A in FIG. 6. The platform sections function like platform sections 46 (FIGS. 1–5) but are formed as part of an integral L-shaped block having a depending leg portion 84 defining a stop plate with an angled abutment surface 86 which functions like abutment surface 56 of stop plate 54 (FIGS. 1–5).

Guide surface means in the form of a plate 88 is provided at opposite sides of the sheet path and includes an upwardly flared entry end 90 for acting against a lead end of each sheet to prevent upward escape of the sheets from the path, similar in operation to upwardly flared end 50 of guide surface means 48 (FIGS. 1–5).

As with the first embodment, platform sections 82, stop plates 84 and guide plate 88 with upwardly flared end 90 are disposed at opposite sides of the sheet path and extend laterally into the path for engaging the sheets at their marginal side edges. This is important so that these components do not "track" the printing on the copy sheets. To this end, each platform section 82, stop plate 84 and guide plate 88 are secured to a mounting block 92 which is secured to a respective side wall 38 of sheet receiving tray 14. Each mounting block includes an outer mounting plate 94 having a slot 96 elongated in the direction of the sheet path of travel. A fastener 98, similar to fastener 70, extends through a cut-out 44 in tray side wall 38 and is threaded into mounting block 92. Thus, the mounting block, including platform section 82, stop plate 84 and guide plate 88, are adjustable on the tray side wall longitudinally of the sheet path to accommodate sheets of varying weights or types. Both embodiments include a conventional front stop 99 at the front of the tray, and back stop 20 is longitudinally adjustable to accommodate different sizes of sheets, as is known.

The deflecting means for diverting each sheet downwardly into the receiving tray to clear the path for a succeeding sheet in the form of the invention shown in FIGS. 6–10, comprise means for directing a stream of air into the sheet path. More particularly, a perforated tube 100 extends laterally across and above the path for directing air jets 102 downwardly against the top surface of a subjacent sheet. The ends of the perforated tube rest in saddles 104 in mounting blocks 92. One end, the left-hand end in FIG. 6, of perforated tube 100 has a fitting 106 for receiving a conduit 108 connected to an appropriate air supply.

In operation of the sheet stacking device of FIGS. 6–10, sheets are delivered seriatim from the machine between ejector wheels 22 and roller 24 and onto platform sections 82 at the marginal side edges of the sheet. The platform sections direct each sheet from the machine in a path outwardly over tray 14. Upwardly flared end 90 of guide plate 88 acts against the lead end of the sheet to prevent upward escape of the sheet from the path. Air jets 102 emitting from perforated tube 100 divert each sheet downwardly into the tray to clear a path for a succeeding sheet. The air jets particularly divert the trail end of each sheet downwardly to clear the path for an oncoming sheet. With high speed operation, the trail end of the sheet normally will kick back against abutment surface 86 of stop plate 84 which will control and guide the sheet downwardly into the tray and into alignment onto the stack S of sheets in the tray, as indicated by arrow D (FIG. 9).

The vertical height of perforated air tube 100 is adjustable relative to the sheet path. With particular reference to FIGS. 9 and 10, an adjusting plate 110 is positioned to ride longitudinally on guide plate 88. Adjusting plate 110 has a slot 112 which is elongated in the direction of the sheet path. A fastening screw 114 extends through slot 112 and is threaded into mounting block 92. Adjusting plate 110 hasa stepped end 110 formed with a plurality of concave steps 116 for selectively supporting air tube 100. By loosening fastener 114, adjusting plate 110 can be moved in the direction of double-headed arrow E (FIG. 10) to bring a selected one of steps 116 into registry with the saddle 104 in mounting block 92. This adjustment and selection of the steps will raise or lower air tube 100 in the direction of double-headed arrow F (FIG. 10). Different positions of adjustment are shown by the full-line and phantom positions in FIG. 10. An upstanding pin 118 is provided on adjusting plate 110 to permit manual manipulation of the plate when threaded fastener 110 is loosened.

A biasing wheel 120 is rotatably mounted at the center of air tube 100 between a pair of spaced brackets 122 which are fixed to the tube. The biasing wheel bears against the sheets passing beneath the wheel to cause the sheets to bow as shown in FIG. 7. Bowing the sheets increases the affect of air jets 102 by creating a transverse pocket in each sheet. Bowing the sheets also rigidifies the sheets so that the lead ends thereof do not flip upwardly when traveling at high speeds into the tray. The biasing wheel has a rough peripheral surface, as by coating the surface with silica particles, to prevent tracking the copy sheets.

A single flexible strap or deflector 124 is fixed by a thumb nut 126 to a brace plate 128 extending between brackets 122. The strap bows downwardly as shown in FIG. 8 and deflects the lead ends of the sheets downwardly against back stop 20. The strap is positioned above the sheet path so that the sheets strike only the back or distal end of the strap to preclude creating static electricity in the sheets.

Thus, it can be seen that a new and improved sheet stacking device has been provided for accurately aligning and stacking sheets issuing from a printing machine or the like at high speeds without sheet jamming. The sheet support means, guide means, deflecting means and stop means all contribute to controlling and directing the sheets in a positive manner such that production speeds of the printing machine can be increased substantially without expensive mechanisms. The device is adjustable to accommodate sheets of various weights or types. Both embodiments of deflecting means rapidly divert each sheet, particularly the trailing edge thereof, downwardly out of its path of travel into the tray to clear the path for a succeeding sheet.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A sheet stacking device for use in a printing, copying or duplicating machine, or the like, wherein sheets are delivered seriatim to a receiving tray whereat the sheets drop by gravity onto a stack of sheets in the tray, comprising:

platform means for directing each sheet from the machine in a generally straight line path outwardly over the tray; and guide means for controlling movement of each sheet into the tray, including stationary guide surface means extending laterally into said path and generally parallel thereto for engaging the sheets only at their marginal side edges and having an upwardly flared entry portion angled forwardly above said path at the forward end of the guide surface means to prevent upward escape of the sheets from the path, a middle portion extending generally parallel to said path, a downwardly flared portion angled rearwardly below said path at the rear end of the guide surface means for directing at least a trail end of each sheet downwardly into the tray to clear the path for the lead end of a succeeding sheet directed into the path, and said portions being generally planar.

2. The device of claim 1, including means for adjusting the position of said guide surface means longitudinally of the path to accommodate sheets of varying weights or types.

3. The device of claim 1, including stop means beneath said guide means for acting against the trail ends of the sheets deflected into the tray to control and guide the sheets into alignment onto the stack in the tray.

4. The device of claim 3 wherein said stop means comprises an abutment surface angled downwardly and forwardly relative to the path.

* * * * *